US006881132B2

(12) United States Patent
Mizuno

(10) Patent No.: US 6,881,132 B2
(45) Date of Patent: Apr. 19, 2005

(54) GRINDING WATER TANK UNIT FOR USE IN PROCESSING EYEGLASS LENS, DEVICE FOR SEPARATING PROCESSING DEBRIS, AND EYEGLASS LENS PROCESSING APPARATUS HAVING THE TANK UNIT OR DEVICE

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 218 days.

(21) Appl. No.: 10/224,575

(22) Filed: Aug. 21, 2002

(65) Prior Publication Data

US 2003/0017791 A1 Jan. 23, 2003

Related U.S. Application Data

(63) Continuation of application No. 10/186,978, filed on Jul. 2, 2002, now abandoned.

(30) Foreign Application Priority Data

Jul. 3, 2001 (JP) ..... 2001-202808
Jul. 31, 2001 (JP) ..... 2001-232203
Jul. 31, 2001 (JP) ..... 2001-232204

(51) Int. Cl.[7] ..... B24B 1/00; B24B 7/30
(52) U.S. Cl. ..... 451/60; 451/64; 451/444; 451/255
(58) Field of Search ..... 451/60, 64, 36, 451/41–44, 87–88, 255–256, 323–325, 444–447, 453, 459

(56) References Cited

U.S. PATENT DOCUMENTS

| | | | | |
|---|---|---|---|---|
| RE35,898 | E | 9/1998 | Shibata et al. | |
| 6,547,961 | B1 * | 4/2003 | Uto et al. | 210/167 |
| 6,572,460 | B1 * | 6/2003 | Mizuno | 451/178 |
| 6,672,948 | B1 * | 1/2004 | Mizuno | 451/60 |
| 2002/0132568 | A1 * | 9/2002 | Mizuno | 451/255 |
| 2003/0008603 | A1 * | 1/2003 | Mizuno | 451/64 |
| 2003/0017791 | A1 * | 1/2003 | Mizuno | 451/60 |
| 2004/0053564 | A1 * | 3/2004 | Mizuno | 451/60 |

FOREIGN PATENT DOCUMENTS

| | | |
|---|---|---|
| DE | 42 01 525 | 7/1993 |
| JP | 1-29005 Y2 | 9/1989 |
| JP | 2514215 Y2 | 7/1995 |
| JP | 8-118236 | 5/1996 |
| JP | 9-239661 | 9/1997 |
| JP | 11-320407 A | 11/1999 |
| JP | 11-320408 A | 11/1999 |
| JP | 11-320408 | 11/1999 |
| JP | 11-347940 | 12/1999 |

* cited by examiner

*Primary Examiner*—Lee D. Wilson
(74) *Attorney, Agent, or Firm*—Sughrue Mion, PLLC

(57) ABSTRACT

A grinding water tank unit which enables reuse of grinding water that has been used for processing an eyeglass lens, includes: a tank in which the grinding water is stored; a filter, disposed in the tank, for filtering the grinding water to be separate from processing debris, the filter having a sealed hollow portion; a first water suction pump; and a first water suction passage which connects the hollow portion to the first pump, and through which the grinding water filtered by the filter is sucked by suction of the first pump.

20 Claims, 6 Drawing Sheets

GRINDING WATER TANK UNIT FOR USE IN PROCESSING EYEGLASS LENS, DEVICE FOR SEPARATING PROCESSING DEBRIS, AND EYEGLASS LENS PROCESSING APPARATUS HAVING THE TANK UNIT OR DEVICE

This is a continuation of application Ser. No. 10/186,978 filed Jul. 2, 2002, now abandoned; the disclosure of which is incorporated herein by reference.

BACKGROUND OF THE INVENTION

1. Field of the Invention

The invention relates to an eyeglass lens processing apparatus for processing eyeglass lenses; to a grinding water tank unit for storing and circulating grinding water; and to a processing debris separator for separating grinding water from processing debris.

2. Description of the Related Art

Grinding water is fed to an eyeglass lens processing apparatus in order to cool a portion of a lens to be processed and remove debris produced during the course of processing the lens. A water-supply method employed in this connection may be classified into a waterline direct coupling method for supplying water from a waterline directly to a processing apparatus main unit; and a circulation method. According to the circulation method, grinding water stored in a tank is pumped up and fed to the processing apparatus main unit using a pump. Grinding water having been used is drained into the tank, and the grinding water is then reused.

The waterline direct coupling method presents a problem of processing debris being drained directly into sewage from the processing apparatus main unit together with used grinding water. Even the circulation method suffers a problem of difficulty in completely separating processing debris from grinding water, thereby requiring effort in removing solely processing debris. Another problem of the circulation method lies in that a portion of processing debris is drained into a sewage along with the grinding water stored in the tank at the time of replacement of grinding water.

When a plastic lens is processed, bubbles develop in drained grinding water. Particularly, when the eyeglass processing apparatus of circulation type performs processing operation over a period of time, the tank is filled with bubbles, sometimes resulting in leakage of bubbles from the tank or overflow of bubbles to a processing chamber of the processing apparatus main unit. For this reason, replacement of grinding water and cleaning of inside of the tank must be performed at frequent intervals.

SUMMARY OF THE INVENTION

In light of the drawback in the related art, an object of the invention is to provide an apparatus capable of readily separating grinding water in a tank from processing debris.

Another object of the invention is to provide an apparatus capable of diminishing the amount of bubbles developing in a tank.

To solve the drawback, the invention is characterized by the following arrangements.

(1) A grinding water tank unit which enables reuse of grinding water that has been used for processing an eyeglass lens, comprising:

a tank in which the grinding water is stored;

a filter, disposed in the tank, for filtering the grinding water to be separate from processing debris, the filter having a sealed hollow portion;

a first water suction pump; and a first water suction passage which connects the hollow portion to the first pump, and through which the grinding water filtered by the filter is sucked by suction of the first pump.

(2) The tank unit according to (1), wherein the filter includes a substantially plate-like filter which is disposed at a bottom of the tank, and which has a filter surface substantially equal in area to an interior bottom surface of the tank.

(3) The tank unit according to (2), wherein the filter has the hollow portion defined between the filter and the interior bottom surface of the tank.

(4) The tank unit according to (1), further comprising:

a first water supply passage which connects the first pump to the tank, and through which the grinding water sucked by the first pump is supplied to the tank.

(5) The tank unit according to (1), further comprising:

an antifoaming device for eliminating bubbles developing in the tank.

(6) The tank unit according to (5), wherein the antifoaming device has a water ejection opening disposed at a predetermined height in the tank, and eliminates the bubbles using water pressure of water ejected from the water ejection opening.

(7) The tank unit according to (6), further comprising:

a second water suction pump;

a second water suction passage which connects the tank to the second pump, and through which the grinding water in the tank is sucked by suction of the second pump; and a second water supply passage which connects the second pump to the water ejection opening, and through which the grinding water sucked by the second pump is supplied to the water ejection opening.

(8) The tank unit according to (6), wherein an ejection direction of the water ejection opening is changeable.

(9) An eyeglass lens processing apparatus for processing an eyeglass lens, comprising:

a processing chamber in which a lens grinding tool is disposed;

a tank in which grinding water is stored;

a drain passage through which the grinding water is drained from the processing chamber to the tank;

a filter, disposed in the tank, for filtering the grinding water to be separate from processing debris, the filter having a sealed hollow portion;

a water suction pump; and a water suction passage which connects the hollow portion to the pump, and through which the grinding water filtered by the filter is sucked by suction of the pump.

(10) The eyeglass lens processing apparatus according to (9), further comprising:

a water supply unit for supplying the grinding water stored in the tank to the processing chamber.

(11) The eyeglass lens processing apparatus according to (10), further comprising:

a water supply passage which connects the pump to the tank, and through which the grinding water sucked by the pump is supplied to the tank.

(12) A processing debris separating device for separating grinding water, used for processing an eyeglass lens and drained to a tank, from processing debris, comprising:

a filter, disposed in the tank, for filtering the grinding water to be separate from the processing debris, the filter having a sealed hollow portion;

a water suction pump; and a water suction passage which connects the hollow portion to the pump, and through which the grinding water filtered by the filter is sucked by suction of the pump.

(13) A grinding water tank unit which enables reuse of grinding water that has been used for processing an eyeglass lens, comprising:

a first tank in which the grinding water is stored;

a filter for filtering the grinding water to be separate from processing debris, the filter having a chamber in which the processing debris is accumulated;

a pressurizing pump;

a water suction passage which connects the first tank to the pump, and through which the grinding water in the first tank is sucked by suction of the pump; and a first water supply passage which connects the pump to the chamber of the filter, and through which the grinding water sucked by the pump is supplied to the chamber under a predetermined water pressure.

(14) The tank unit according to (13), wherein the filter is disposed in the first tank.

(15) The tank unit according to (13), wherein the filter is disposed in a second tank provided outside the first tank.

(16) The tank unit according to (15), further comprising:

a second water supply passage which connects the second tank to the first tank.

(17) The tank unit according to (15), further comprising:

an anti-foaming device for eliminating bubbles developing in the first tank.

(18) An eyeglass lens processing apparatus for processing an eyeglass lens, comprising:

a processing chamber in which a lens grinding tool is disposed;

a tank in which grinding water is stored;

a drain passage through which the grinding water is drained from the processing chamber to the tank;

a filter for filtering the grinding water to be separate from processing debris, the filter having a chamber in which the processing debris is accumulated;

a pressurizing pump;

a water suction passage which connects the tank to the pump, and through which the grinding water in the tank is sucked by suction of the pump; and a water supply passage which connects the pump to the chamber of the filter, and through which the grinding water sucked by the pump is supplied to the chamber under a predetermined water pressure.

(19) The eyeglass lens processing apparatus according to (18), further comprising:

a water supply unit for supplying the grinding water stored in the tank, to the processing chamber.

(20) A processing debris separating device for separating grinding water, used for processing an eyeglass lens and drained to a tank, from processing debris, comprising:

a filter for filtering the grinding water to be separate from the processing debris, the filter having a chamber in which the processing debris is accumulated;

a pressurizing pump;

a water suction passage which connects the tank to the pump, and through which the grinding water in the tank is sucked by suction of the pump; and a water supply passage which connects the pump to the chamber of the filter, and through which the grinding water sucked by the pump is supplied to the chamber under a predetermined water pressure.

The present disclosure relates to the subject matter contained in Japanese patent application Nos. 2001-202808 (filed on Jul. 3, 2001), 2001-232203 (filed on Jul. 31, 2002) and 2001-232204 (filed on Jul. 31, 2002), which are expressly incorporated herein by reference in their entireties.

DESCRIPTION OF THE PREFERRED EMBODIMENT

First Embodiment

Figure 1:
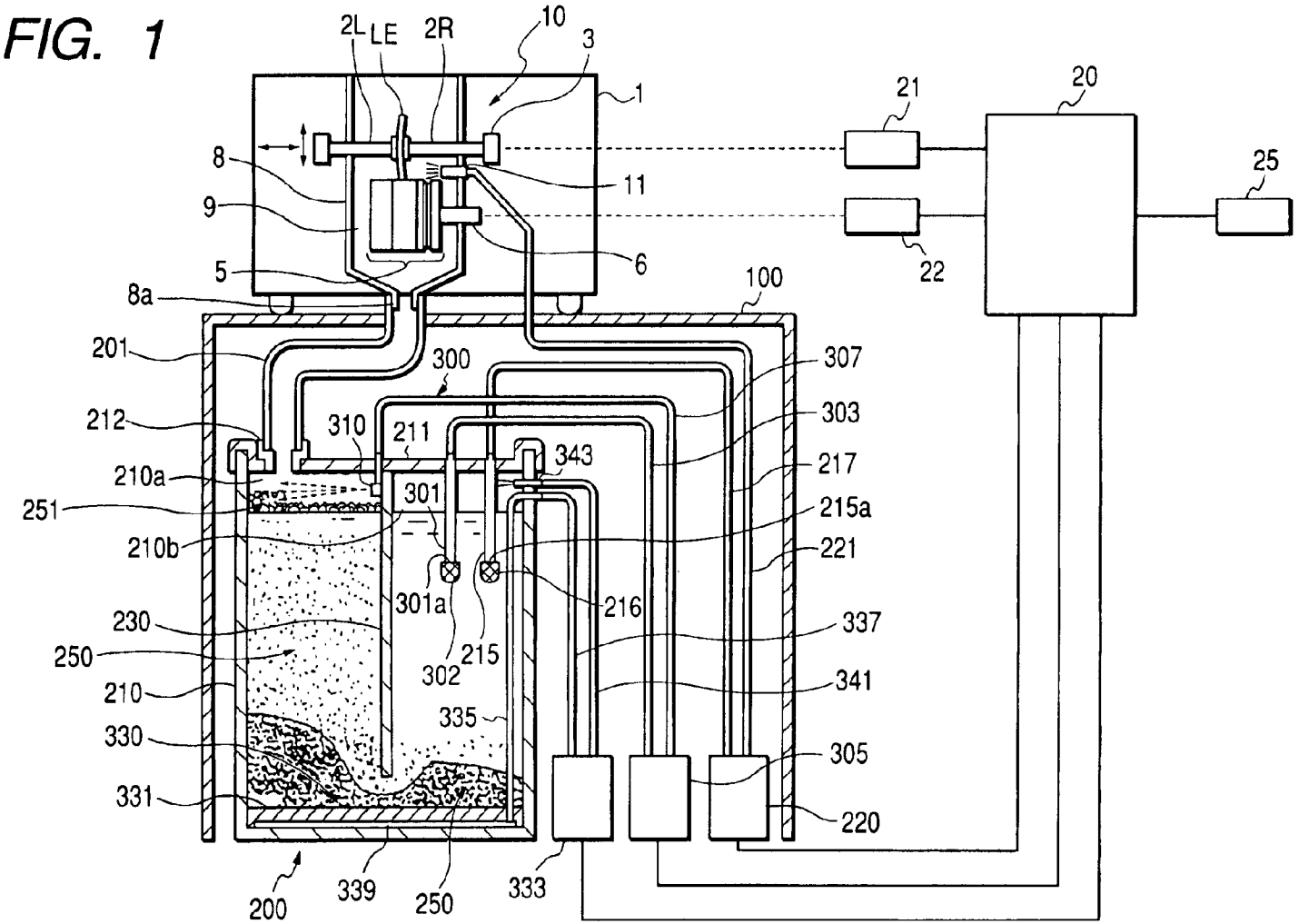
FIG. 1 is an overall schematic diagram of an eyeglass lens processing apparatus according to a first embodiment.

An embodiment of the invention will now be described by reference to the drawings. FIG. 1 is an overall schematic diagram of an eyeglass lens processing apparatus according to a first embodiment of the invention. The processing apparatus is roughly constituted of a processing apparatus main unit 1; a table 100 on which the main unit 1 is to be placed; and a circulation-type grinding water tank unit 200 to be placed in the table.

Disposed in the housing of the main unit 1 is a processing section 10 comprising two lens rotary shafts (e.g., chuck shafts) 2R, 2L for holding a lens LE to be processed; a carriage section 3 to which the lens rotary shafts 2R, 2L are rotatably attached; and a grinder 5 attached to a rotary shaft 6 for processing the edge of the lens LE. The grinder 5 is constituted of three grinding stones: namely, a rough grinding stone for plastics; a rough grinding stone for glass; and a finishing grinding stone having a groove for beveling and a flat processing surface. The grinder 5 is rotated by an unillustrated motor. The carriage section 3 is movable in the axial direction of the lens rotary shafts 2R, 2L, and also movable relative to the grinder 5. For more details of the processing section 10, please refer to Reference No. 35,898 (Japanese Patent Application Laid-Open No. 212661/1993).

A processing chamber 9 is defined by a waterproof cover 8 disposed within the main unit 1 so as to enclose the lens LE to be held by the lens rotary shafts 2R, 2L, as well as the grinder 5. A nozzle 11 for spraying grinding water extends into the processing chamber 9. The nozzle 11 is connected to a water suction pump 220 of a tank unit 200 by a water supply hose 221. During the course of processing of the lens LE, grinding water is sprayed out of the nozzle 11. The thus-sprayed grinding water and processing debris 250 (grinding wastes) of the lens LE are drained into a grinding water reservoir tank 210 of the tank unit 200 by way of a drain hole 8*a* formed in a lower portion of the cover 8, and a drain hose 201.

The tank 210 has a cylindrical shape with a bottom, and is equipped with an unillustrated handle so as to be portable. The tank 210 is not limited to a cylindrical shape but may be box-shaped.

Figure 2:
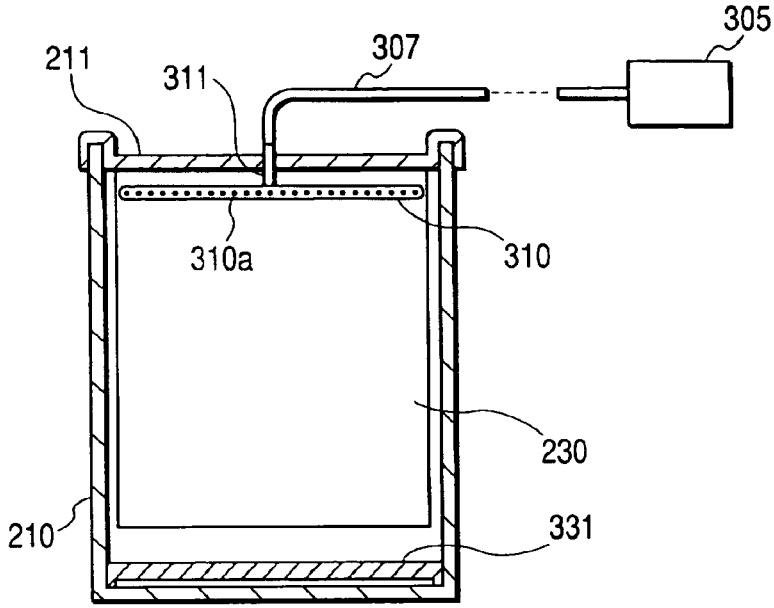
FIG. 2 is a schematic diagram of an antifoaming device.

A lid 211 for substantially hermetically sealing the inside of the tank 210 is removably fitted in an opening section formed in an upper part of the tank 210. A partition plate 230 to be used for dividing the inside of the tank 210 into a drainage chamber 210*a* and a water suction chamber 210*b* is fixedly provided in the vicinity of the center of the lid 211. As shown in FIG. 2, a clearance (i.e., opening) for ensuring a passage along which grinding water is to flow is formed between an interior side surface of the tank 210 and side edges of the partition plate 230 and between an interior bottom surface of the tank 210 and a lower edge of the partition plate 230 (the drainage chamber 210*a* and the water suction chamber 210*b* are partially connected to each other).

A connection opening 212 to which the hose 201 is to be connected is formed in an area of the lid 211 located above the drainage chamber 210*a*. Grinding water introduced by the hose 201 is drained into the tank 210 by way of the connection opening 212. A water suction pipe 215 is attached to an area of the lid 211 located above the water suction chamber 210*b* so as to extend downward. A filter 216 having a coarse mesh screen is attached to a water suction opening 215*a* provided at the lower end of the pipe 215. A water suction hose 217 is connected to an upper end of the pipe 215 projecting from an upper surface of the lid 211. The other end of the hose 217 is connected to the pump 220. By driving operation of the pump 220, the grinding water pumped up (acquired) by way of the pipe 215 is introduced to the nozzle 11 by way of the hose 217 and the hose 221. Here, the connection opening 212 and the water suction opening 215*a* are preferably located as far as possible from the partition plate 230.

The partition plate 230 is provided for purposes of hindering the processing debris 250 mixed in the drained grinding water in reaching the water suction opening 215*a* as well as facilitating the processing debris 250 to be settled at the bottom of the tank 210. Accordingly, the partition plate 230 may be dispensed with.

The tank unit 200 is equipped with an antifoaming device 300 for eliminating (breaking) bubbles 251 by spraying a fluid (e.g., grinding water in this embodiment). The antifoaming device 300 has a water suction pipe 301 attached to the lid 211 for sucking grinding water from the water suction chamber 210*b*; a water suction pump 305; a water suction hose 303 for connecting the pipe 301 to the pump 305; a nozzle 310 for spraying the grinding water pumped by the pump 305 to the drainage chamber 210*a*; and a water supply hose 307 for connecting the pump 305 to the nozzle 310. A filter 302 having a coarse mesh screen is attached to a water suction opening 301*a* formed at a lower end of the pipe 301.

The nozzle 310 is attached to an upper part of the partition plate 230. As shown in FIG. 2, the nozzle 310 has the shape of a rod. A large number of spray openings 310*a* are formed in a longitudinal side surface of the nozzle 310 so as to spray grinding water in a substantially horizontal direction. The spray openings 310*a* are provided so as to situate in a position above a water surface when grinding water is poured (stored) in the tank 210. In the case of the horizontally long nozzle 310 such as that shown in FIG. 2, the spray openings 310*a* are preferably provided in the entire area occupying from the center of the tank 210 to the vicinities of the interior side surface of the tank 210 so that sprayed grinding water can cover, to the extent possible, the inside of the tank 210 (i.e., the drainage chamber 210*a*). The grinding water supplied by the pump 305 by way of the hose 307 is introduced from a connection opening 311 formed in the vicinity of the center of the nozzle 310 and sprayed at a predetermined water pressure by way of the spray openings 310*a*. The thus-sprayed grinding water can suppress foaming of the bubbles 251 in the tank 210 (i.e., the drainage chamber 210*a*)

The tank unit 200 is provided with a processing debris separator 330 which facilitates settlement of the processing debris 250 and separates grinding water from the processing debris 250. The processing debris separator 330 comprises a filter 331 provided on the bottom of the tank 210; a water suction pump 333 for pumping grinding water stored in the tank 210 by way of the filter 331; a water suction pipe 335 and a water suction hose 337 for connecting the pump 333 to a hollow section 339 defined between the filter 331 and the interior bottom surface of the tank 210; a connection opening 343 formed in a side surface of the tank 210; and a water-supply hose 341 for connecting the pump 333 to the connection opening 343.

A sintered porous member is preferably employed as the filter 331. The embodiment employs sintered porous plastic member produced by sintering plastic beads, by virtue of its lightweight, durability, and superior machinability. The sintered porous plastic member is formed principally from polyethylene, polypropylene, ethylene-vinyl-acetate-copolymer or the like. The embodiment employs a filter 331 having a pore size of about 15 $\mu$m. The present inventor conducted tests using a filter having a pore size of 15 $\mu$m and a filter having a pore size of 70 $\mu$m. The grinding water that has passed through the filter having a pore size of 70 $\mu$m was ascertained to cause a whitish turbidity. The 70 $\mu$m filter was confirmed to have low filtering accuracy. When filtering was continued further with the 70 $\mu$m filter, minute processing debris was ascertained to clog the filter, thereby lowering a filtering rate. In contrast, the filter having a pore size of 15 $\mu$m was ascertained to produce transparent filtered grinding water and have less effect on a filtering rate even when filtering operation was performed continuously. Accordingly, use of a filter having a pore size smaller than 70 $\mu$m (e.g., 15 $\mu$m or thereabouts) for the filter 331 is preferable in terms of filtering accuracy and filtering rate.

Figure 3:
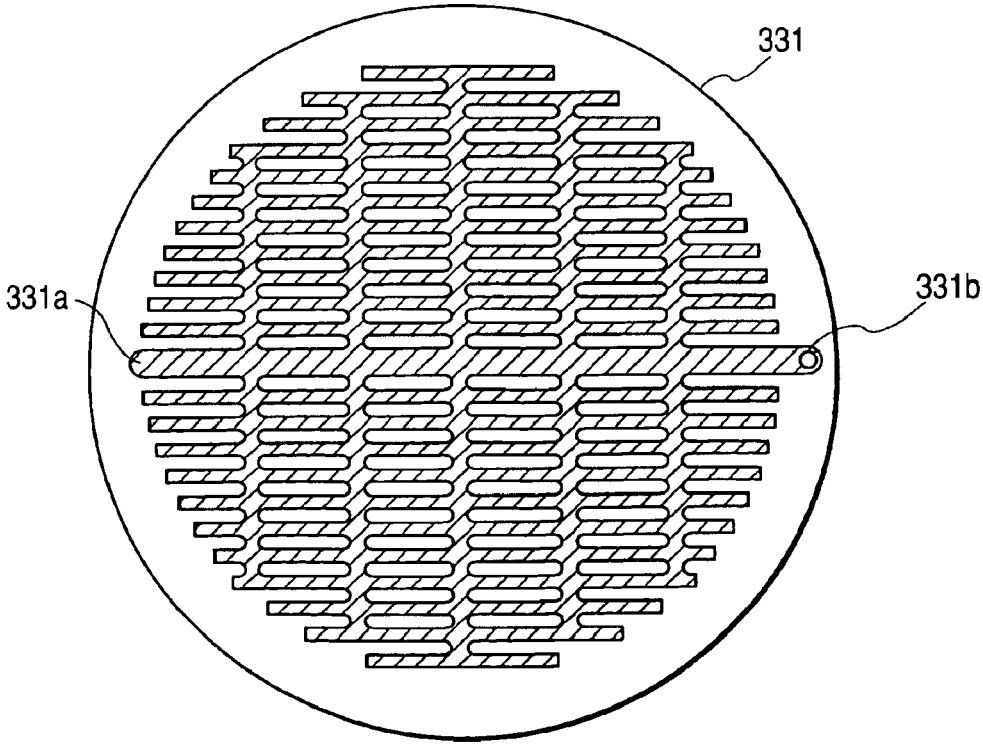
FIG. 3 is a view of a filter of the apparatus of the first embodiment when viewed from a bottom surface of a tank.

FIG. 3 is an illustration of the filter 331 when viewed from the bottom surface of the tank 210. The filter 331 is disposed on the bottom of the tank 210 having a circular cross-sectional shape, and therefore has the shape of a disk which is substantially identical in area with the interior bottom surface of the tank 210. The filter 331 has a thickness of 7 mm. A grid-shaped groove 331*a* (the hatched portion in FIG. 3) having a depth of 2 mm is formed in the lower surface of the filter 331 (i.e., the surface facing the interior bottom surface of the tank 210). A suction opening 331*b* to be connected to the pipe 335 is formed in the center portion of the groove 331*a*. The groove 331*a* serves as a passage along which filtered grinding water flows, and is formed so that all portions of the groove 331 communicate with the suction hole 331*b*. The filter 331 is placed on the bottom of the tank 210 such that the outer periphery of the filter 331 is bonded to the interior side surface of the tank 210 in a shielding manner. The hollow section 339 is established by the groove 331*a* and the interior bottom surface of the tank 210, thereby ensuring a passage for sucking or aspirating filtered grinding water.

The lower surface of the filter 331 is given a groove structure for preventing occurrence of fracture or deformation in the filter 331, which would otherwise be caused by the weight of the processing debris 250 settled (accumulated) on the upper surface of the filter 331 and the weight of the grinding water. Therefore, the groove structure is not inevitable. For instance, the lower surface of the filter 331 may be made flat, and blocks may be disposed below the lower surface of the filter 331 so as to ensure a groove 331*a* similar to that shown in FIG. 3, thereby forming the hollow section 339. Alternatively, a cloth filter having a mesh structure, such as a cotton filter, may be employed as the filter 331. Even in this case, the only requirement is that a reinforcement frame be disposed so as to constitute the hollow section 339.

If the tank 210 is rectangular in a horizontal cross-sectional shape, the filter 331 should also be rectangular.

Reference numeral 20 designates a control section provided in the main unit 1. The control section 20 is connected to the pumps 220, 305, and 333, as well as to a drive unit 22 for rotating the grinder 5 and a drive unit 21 for moving the carriage section 3.

Next, use of such an apparatus will be described. First, grinding water is stored in the tank 210. At this time, a water surface is set so as to become one to two centimeters lower than the nozzle 310 of the antifoaming device 300.

When the main unit 1 has started processing the lens LE, the control section 20 drives the pump 220, whereby the grinding water pumped from the water suction chamber 210*b* is sprayed into the processing chamber 9 by way of the nozzle 11. The thus-sprayed grinding water and the resultant processing debris 250 of the lens LE are drained into the drainage chamber 210*a* by way of the drain hole 8*a* and the hose 201.

At the time of processing of the lens, the pump 333 is activated by a switch 25 connected to the control section 20, in order to promote settlement of the processing debris 250 in the tank 210. Here, the control section 20 may perform a control operation so as to drive the pump 333 in conjunction with driving action of the pump 220.

When the pump 333 is activated, suction pressure is exerted on the hollow section 339 formed below the filter 331, whereby the grinding water stored in the tank 210 is sucked or aspirated and filtered by way of the filter 331. The grinding water pumped by the pump 333 is returned to the tank 210 from the connection opening 343 by way of the hose 341. By this suction, the processing debris 250 are attracted toward the filter 331, whereby settlement of the processing debris 250 is promoted. Further, progress in solidification of the thus-settled processing debris 250 inhibits generation of turbidity in the grinding water stored in the tank 210. Hence, a large amount of processing debris 250 can be accumulated in the tank 210. The processing debris 250 is settled in order of larger size and weight. Accordingly, large processing debris 250 is settled (accumulated) first on top of the filter 331. Hence, clogging of the filter 331 is prevented, and the thus-settled (accumulated) processing debris 250 acts as a new filter.

A permissible storage amount of processing debris 250 in the tank 210 is such a level that settled processing debris 250 is not sucked into the suction openings 215*a*, 301*a* (via the filters 216, 302). Although it depends on the height of the location where the suction opening 215*a* or the like is formed, if about 5 to 6 liters of processing debris 250 can be settled in a 20-liter tank, about 200 lenses can be processed.

A filtering rate of the filter 331 is high at the beginning of a filtering operation. However, as a result of the processing debris 250 deposited on the filter 331, the filtering rate decreases. The filtering rate is also sensitive to the performance of the pump 333. Even when a high-power pump is used as the pump 333, an increase in the quantity of flow (i.e., a flow rate) leads to a sharp rise in a loss stemming from flow of the grinding water through the filter 331 (i.e., a flow loss). For this reason, driving of the pump 333 with appropriate suction is preferable in terms of preventing overload. The eyeglass lens processing apparatus adopts as the pump 333 a gear pump using a DC motor, and the pump is activated with a constant current. In the case of low filter resistance (flow loss), such a pump achieves at a higher rotational speed and a larger flow rate. In contrast, when load on the motor becomes high as a result of increase in filter resistance, the motor operates at a low current and is controlled so as to reduce the rotational speed of the motor, thereby preventing overload.

With a view toward controlling generation of bubbles during the course of processing of a plastic lens, an antifoaming agent is usually added to the grinding water stored in a circulation-type tank unit. However, when the grinding water including an antifoaming agent is filtrated using the filter 331, the filtering performance of the filter 331 is greatly deteriorated by a surfactant included in the antifoaming agent. The reason for this is that processing debris enters and clogs the filter 331. In order to prevent this adverse effect, the eyeglass lens processing apparatus does not employ any antifoaming agent. However, if no antifoaming agent is used, processing of few plastic lenses (e.g., 20 to 30) would involve generation of a large amount of bubbles, thereby requiring frequent replacement of grinding water.

The eyeglass lens processing apparatus eliminates the bubbles 251 by use of an antifoaming device 300. The pump 305 is activated in conjunction with driving action of the pump 220 so that the grinding water is sprayed from the spray openings 310*a* of the nozzle 310 to the drainage chamber 210*a* as a shower. The thus-sprayed water comes into collision with the bubbles at a predetermined water pressure, thereby breaking the bubbles. In this way, the processing debris which is included in the bubbles and can be settled is separated, and the thus-separated debris can be settled.

Figure 4A:
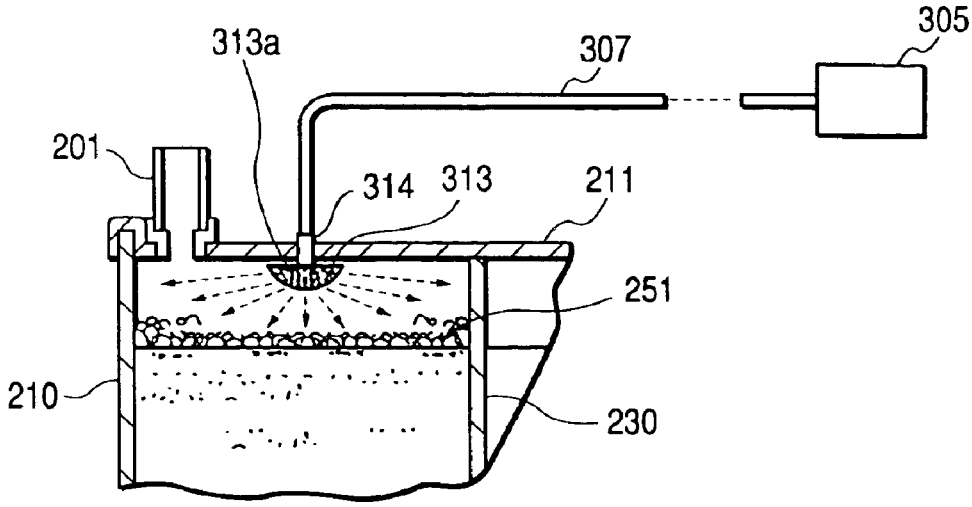
FIG. 4A is a view showing a first modification of the antifoaming device.
Figure 4B:
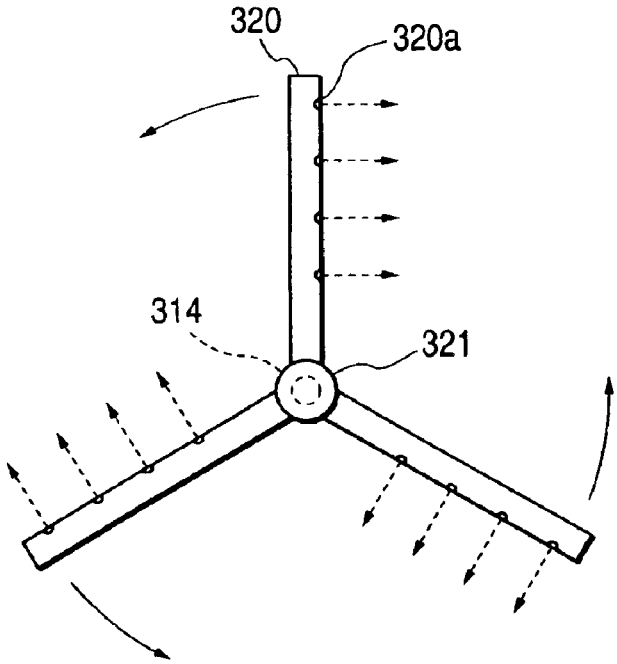
FIG. 4B is a view showing a second modification of the antifoaming device.

The configuration and layout of the nozzle 310 are not limited to those described previously. The nozzle 310 may have, for example, the following configurations. FIGS. 4A and 4B show modifications of the antifoaming device 300. A nozzle 313 shown in FIG. 4A has a hemispherical shape, and a large number of spray openings 313*a* are formed in the hemispherical surface. A connection opening 314 is attached to the lid 211 such that the nozzle 313 is situated in the vicinity of the center of the drainage chamber 210*a*. The grinding water supplied from the pump 305 is sprayed from the spray openings 313*a* of the nozzle 313 by way of the hose 307 and the connection opening 314 to be ejected toward the bubbles in the tank 210 at a predetermined water pressure. Further, if the apparatus is provided with a mechanism for rotating the nozzle 313 so as to change the spraying direction, the grinding water will be sprayed so as to be distributed over the entire inside of the tank 210 (the drainage chamber 210*a*), thereby eliminating bubbles more efficiently. A rotary mechanism which undergoes rotation by use of a motor, water pressure, or reactive force of a jet can be employed as a mechanism for rotating the nozzle 313.

A nozzle 320 shown in FIG. 4B is an example of a rotary-type nozzle utilizing reactive force of a jet. A rotary shaft support 321 is attached to the connection opening 314 shown in FIG. 4A. Three rod-shaped nozzles 320 are attached to the rotary shaft support 321. Spray openings 320*a* are formed in one side surface of each nozzle 320. The nozzle 320 is rotated along with the rotary shaft support 321, by means of reactive force of the grinding water sprayed from the spray openings 320*a*.

Even in the case of the nozzle 310 shown in FIGS. 1 and 2, if a mechanism, such as a motor for pivoting the nozzle 310, is provided and the angle at which grinding water is to be sprayed from the spray openings 310*a* is repeatedly changed between a horizontal direction and a slightly-downward direction, elimination of bubbles can be performed more efficiently. The antifoaming device may be constructed such that bubbles are mechanically agitated by rotating a rotary member having rod-shaped arms. Such an antifoaming device breaks bubbles by the arms of the rotary member coming into collision with the bubbles.

There will now be described an operation in which the processing debris 250 stored in the tank 210 is discarded. In this case, the hose 341 is disconnected from the connection opening 343, and the grinding water pumped by the pump 333 is drained to the outside without being returned to the tank 210. The grinding water pumped by the pump 333 is sufficiently filtered by the filter 331 and hence can be drained directly. Alternatively, the grinding water may be poured into a separately prepared water receiver tank for the purpose of recycling. When the pump 333 is activated by turning on the switch 25, the grinding water stored in the tank 210 is gradually pumped and drained to the outside by way of the filter 331. Finally, moisture contained in the processing debris 250 is also subjected to suction. When the moisture content in the processing debris 250 is reduced, the processing debris 250 are subjected to cracking, whereupon air is directly aspirated by way of the filter 331. Hence, suction of grinding water becomes impossible. When no grinding water is drained, the pump 333 is deactivated.

When suction of grinding water has become impossible, the processing debris 250 have a water content of about 40 to 50, and the processing debris 250 is solidified. The thus-solidified processing debris 250 can be readily removed from the tank 210 by simply turning the tank 210 upside down. The processing debris 250 are discarded while being held in a plastic bag or the like. If the water content is 50% or less, no water seeps through the processing debris 250, thereby facilitating discarding of the processing debris 250. When the water content of the processing debris 250 is to be decreased further, the processing debris 250 is left so as to become naturally dried. The thus-discarded processing debris 250 is to be disposed by an industrial waste disposal company.

Figure 5:
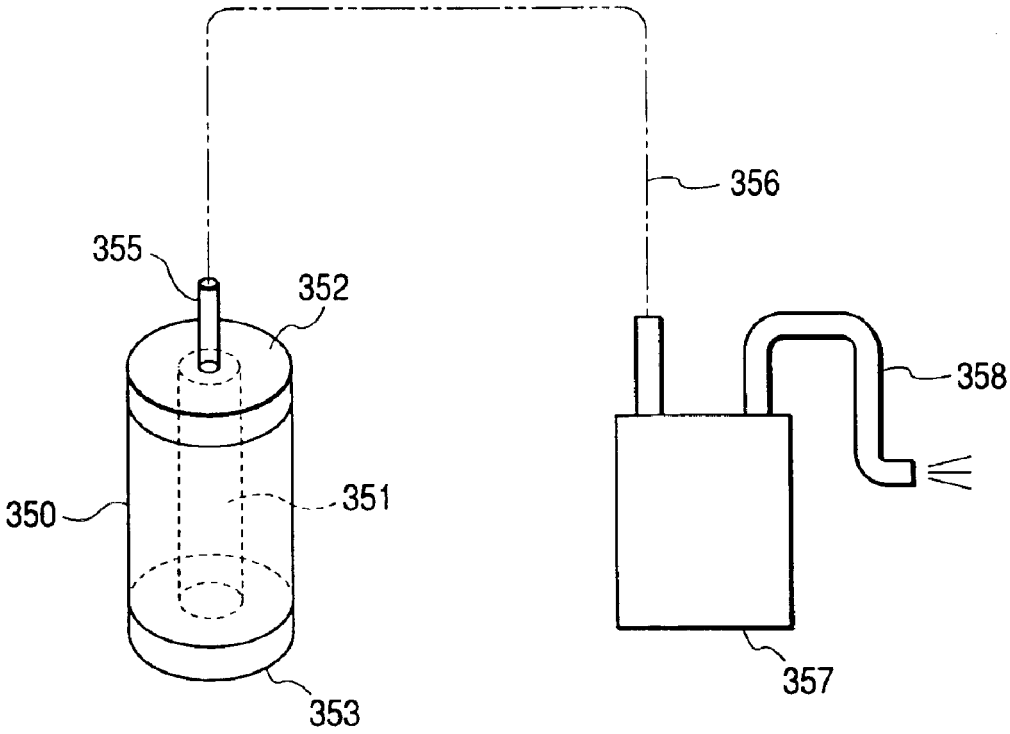
FIG. 5 is a view showing an example in which a processing debris separator is constructed as a discrete device.

The processing debris separator 330 comprising the filter 331, the pump 333, and the like is provided in the circulation-type tank unit 200 to be integral with the tank 210. However, the processing debris separator 330 may be provided separately. FIG. 5 shows an example of such a configuration. Reference numeral 350 designates a cylindrical filter made from sintered porous plastic member. Lids 352, 353 are fixed to respective ends of the filter 350, thereby defining a hollow section 351 in the filter 350. A water suction pipe 355 to be connected to the hollow section 351 is attached to the lid 352. The pipe 355 is connected to a water suction pump 357 by a water suction hose 356. The grinding water pumped by the pump 357 is drained by way of a drain hose 358. When the processing debris 250 accumulated in the tank 210 is discarded, the filter 350 is inserted into the tank 210. The pump 357 is then activated, thereby pumping the grinding water in the tank 210 while filtering and draining, whereby the processing debris 250 can be separated and removed.

When separation of grinding water from processing debris is promoted, a plurality of such filters 350 should be prepared. As a matter of course, if a plate for sealing purpose is secured on the bottom of the filter 331 so as to ensure the hollow section 339 through use of the plate-like filter 331 shown in FIGS. 1 and 3, the filter can be used solely. Alternatively, the filter 350 may be provided in a tank prepared separately from the tank 210, and grinding water including the processing debris 250 may be poured into the tank, thus separating the grinding water from the processing debris 250.

Second Embodiment

Figure 6:
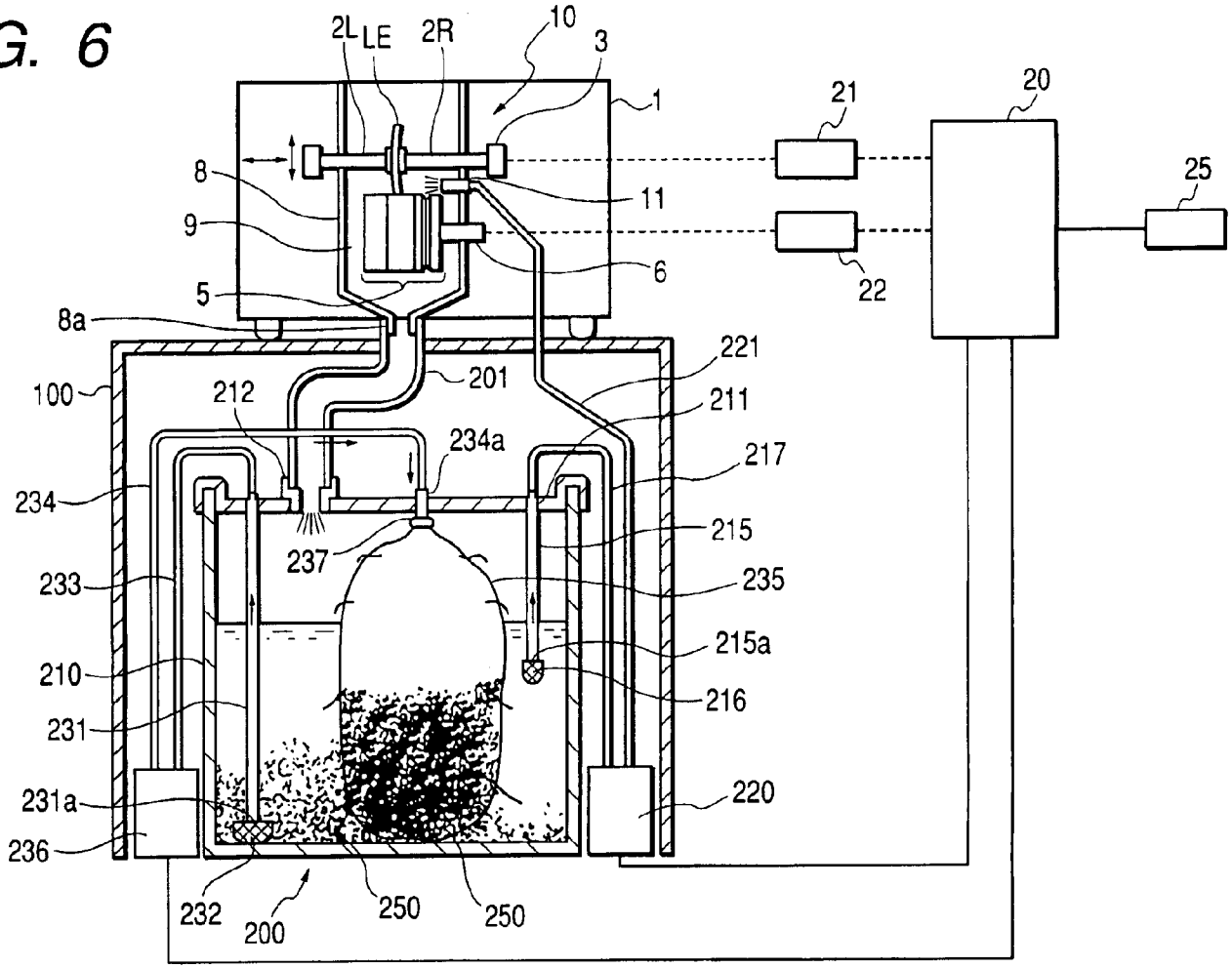
FIG. 6 is an overall schematic diagram showing an eyeglass lens processing apparatus according to a second embodiment.

Another embodiment of the invention will be described hereinbelow. FIG. 6 is an overall schematic diagram showing an eyeglass lens processing apparatus according to a second embodiment of the invention. Those elements which are identical with those described in connection with the first embodiment are assigned the same reference numerals.

A downwardly extending water suction pipe 231 is provided at a position on one side of the lid 211 opposite from the other side thereof where the pipe 215 is provided. A water suction opening 231*a* provided at the lower end of the pipe 231 is extended to a lower position in the tank 210. A filter 232 having a coarse mesh screen is attached to the water suction opening 231*a* so as to sink to the bottom of the tank 210. Positioning the water suction opening 231*a* close to the neighborhood of the bottom of the tank 210 to the extent possible is preferable, and the water suction opening may be formed in the bottom of the tank 210. In addition, the filter 232 may be eliminated.

A water suction hose 233 is connected to an upper end of the pipe 231 projecting beyond the upper surface of the lid 211. The other end of the hose 233 is connected to a pressure application pump 236 for aspirating (pumping) the processing debris 250 along with grinding water. Moreover, a water supply hose 234 for feeding the thus-aspirated grinding water and the processing debris 250 is connected to the pump 236. A drain hole 234*a* provided at the other end of the hose 234 is extended to the lid 211 and connected to a bag-shaped filter 235 provided in the tank 210. Thus, there is formed a passage to be used for removing and introducing the processing debris 250 that have settled in the tank 210 along with the grinding water, which extends from the water suction opening 231*a* to the filter 235. The pump 236 disposed at a portion of the passage between the water suction opening 231*a* and the filter 235 applies a water pressure of about at least 0.05 Mpa onto the grinding water including the processing debris 250 to charge the same into the filter 235.

The filter 235 is constituted of a cotton cloth having a fine mesh screen. The filter 235 preferably does not permit passage of processing debris of small particle size (on the order of micrometers) and prevents inclusion of any processing debris in filtered water. An opening end of the filter 235 is bundled at the drain hole 234*a* of the hose 234 and fastened with a binding band 237. As a result, the filter 235 is connected to the drain opening 234*a* in a substantially-sealed manner. The filter 235 is separated from the drain hole 234*a* by removal of the band 237 and can be removed from the tank 210.

The filter 235 is not limited to the shape of a bag and may have any shape, so long as the filter can form a chamber for accumulating the processing debris 250 therein.

The drive unit 21, the drive unit 22, the pump 220, and the pump 236 are connected to the control section 20.

Next will be described use of the eyeglass lens processing apparatus discussed above. Since processing debris 250 of a plastic lens and a glass lens is, in general, is heavier than water, the processing debris 250 is settled on the bottom of the tank 210. When the lenses LE are processed consecutively, the amount of processing debris 250 settled in the tank 210 increases.

The pump 236 is activated by the switch 25 (or in conjunction with the driving action of the pump 220), and the processing debris 250 settled on the bottom of the tank 210 are aspirated from the water suction opening 231*a* by way of the filter 232 along with the grinding water. The grinding water including the thus-aspirated processing debris 250 flows through the pipe 231 and the hose 233, is pressurized to a pressure of about 0.06 Mpa by the pump 236, and is charged into the filter 235 by way of the hose 234. The filter 235 does not permit passage of processing debris of fine particles and accumulates the debris 250 therein. Substantially-purified grinding water is discharged to the outside (into the tank 210) so as to seep through the surface of the filter 235.

Here, if the filter 235 having a fine mesh screen and high filtration capability is simply used for filtering grinding water, much time will be consumed. For example, if the filter 235 is connected to the hose 201, filtering operation involves consumption of much time. The hose 201 may become clogged with the grinding water, which would cause leakage of grinding water into the processing chamber 9. In contrast, the pump 236 applies a water pressure of about at least 0.05 Mpa onto the processing water charged into the filter 235. Hence, a filtering rate can be increased significantly. Since the filtering rate can be increased by use of a filter of identical capacity, the rate of recovery of the processing debris 250 settled in the tank 210 is enhanced. Further, soil content of the processing water supplied to the main unit 1 can be decreased.

If processing of lenses and filtering operation are performed repeatedly, the processing debris 250 is stacked on the interior surface of the filter 235. If processing of lenses is continued further, the thus-stacked processing debris 250 per se acts as a filter. Hence, processing debris which are smaller than the screen mesh of the cotton cloth of the filter 235 can be accumulated in the filter 235. By virtue of the stacked processing debris acting as a filter of smaller screen mesh, filtering grinding water requires a longer time. However, water pressure is exerted on the grinding water charged into the filter 235 by the pump 236, and hence consumption of along filtering time is not involved.

If the pump 236 is operated continuously even after completion of processing of a lens, the processing debris 250 contained in the grinding water can be accumulated in the filter 235 even when processing of a lens is halted. In this case, the pump 236 may be controlled using a timer so as to be operated for a given period of time after completion of processing of a lens and then be deactivated automatically. The control section 20 maybe given such a timer function. Further, the control section 20 may repeatedly activate and deactivate the pump 236 after completion of processing of the lens so as to cause repeated expansion and contraction of the filter 235, whereby the processing debris 250 stacked on the interior surface of the filter 235 is peeled and accumulated on the bottom of the filter 235. As a result, even if clogging has induced a decrease in a filtering rate, the filtering rate can be restored.

When the processing debris 250 accumulated in the filter 235 is discarded, the lid 211 is raised, and the filter 235 is removed from the inside of the tank 210. The band 237 of the drain opening 234*a* is then removed, and the filter 235 is separated. The thus-separated filter 235 is further drained, thereby solidifying the processing debris 250 contained in the filter 235. Hence, disposal of the processing debris is facilitated. The processing debris 250 may be discarded together with the filter 235 containing the processing debris therein. Alternatively, only the processing debris 250 may be discarded, and the filter 235 may be reused.

The filter 235 may be placed at a position above the water surface of the grinding water stored in the tank 210 so that the inside of the filter 235 is drained at a time other than when the pump 230 is activated. In this case, the efficiency of processing the processing debris 250 can be enhanced.

Figure 7A:
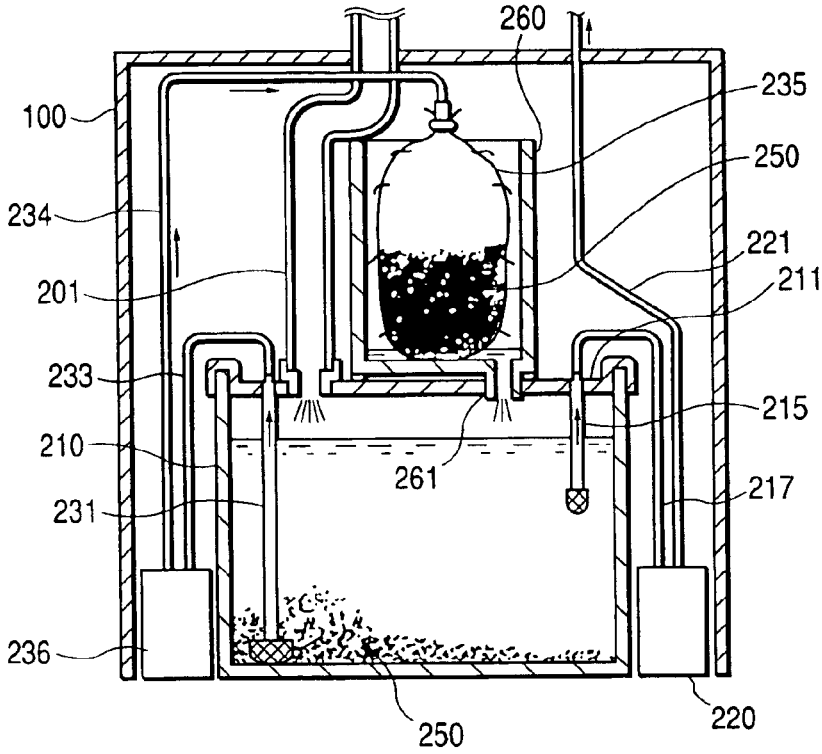
FIG. 7A is a view showing a first modification of filter layout of the apparatus of the second embodiment.
Figure 7B:
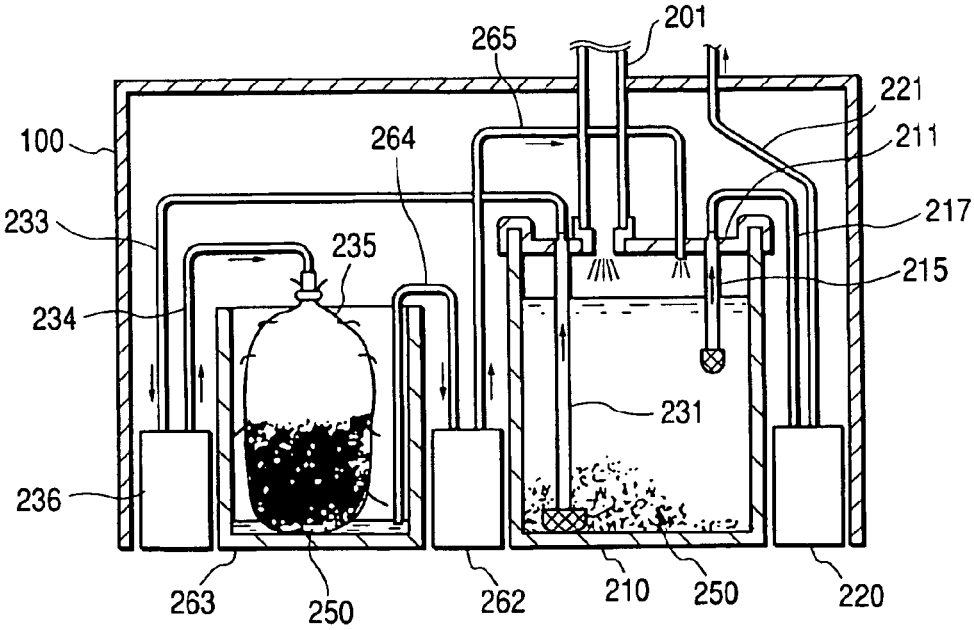
FIG. 7B is a view showing a second modification of filter layout of the apparatus of the second embodiment.

FIGS. 7A and 7B show modifications of layout of the filter 235. FIG. 7A shows an example in which the filter 235 is placed outside (on top of) the tank 210. The grinding water filtered by the filter 235 is drained to the outside of a tank 260 enclosing the filter 235. The tank 260 is placed in a position higher than the tank 210. Hence, the filtered grinding water can be returned to the tank 210 through natural dropping action (gravity) by way of a water supply pipe 261 connecting the tank 260 to the tank 210. FIG. 7B shows an example in which the filter 235 is placed outside (beside) the tank 210. The grinding water filtered by the filter 235 is drained into a tank 263. In this case, a pump 262 is disposed between a water suction hose 264 and a water supply hose 265 for connecting the tank 263 to the tank 210, thereby returning the filtered grinding water into the tank 210. FIGS. 7A and 7B show examples in which the filter 235 is placed outside the tank 210. Hence, the processing debris 250 can be drained within a short period of time after deactivation of the pump 230, thereby enhancing efficiency for processing the processing debris 250.

In addition, the antifoaming device 300 of the first embodiment may be disposed in the-eyeglass lens processing apparatus of the second embodiment.

As has been described, the invention enables easy separation of grinding water and processing debris in a tank. Hence, processing debris can be processed readily. Bubbles in a tank can be reduced without use of an antifoaming agent, and the frequency of replacement of grinding water can be diminished.

What is claimed is:

1. A grinding water tank unit which enables reuse of grinding water that has been used for processing an eyeglass lens, comprising:

a tank in which the grinding water is stored;

a filter, disposed in the tank, for filtering the grinding water to be separate from processing debris, the filter having a sealed hollow portion;

a first water suction pump; and a first water suction passage which connects the hollow portion to the first pump, and through which the grinding water filtered by the filter is sucked by suction of the first pump.

2. The tank unit according to claim 1, wherein the filter includes a substantially plate-like filter which is disposed at a bottom of the tank, and which has a filter surface substantially equal in area to an interior bottom surface of the tank.

3. The tank unit according to claim 2, wherein the filter has the hollow portion defined between the filter and the interior bottom surface of the tank.

4. The tank unit according to claim 1, further comprising:

a first water supply passage which connects the first pump to the tank, and through which the grinding water sucked by the first pump is supplied to the tank.

5. The tank unit according to claim 1, further comprising:

an antifoaming device for eliminating bubbles developing in the tank.

6. The tank unit according to claim 5, wherein the antifoaming device has a water ejection opening disposed at a predetermined height in the tank, and eliminates the bubbles using water pressure of water ejected from the water ejection opening.

7. The tank unit according to claim 6, further comprising:

a second water suction pump;

a second water suction passage which connects the tank to the second pump, and through which the grinding water in the tank is sucked by suction of the second pump; and a second water supply passage which connects the second pump to the water ejection opening, and through which the grinding water sucked by the second pump is supplied to the water ejection opening.

8. The tank unit according to claim 6, wherein an ejection direction of the water ejection opening is changeable.

9. An eyeglass lens processing apparatus for processing an eyeglass lens, comprising:

a processing chamber in which a lens grinding tool is disposed;

a tank in which grinding water is stored;

a drain passage through which the grinding water is drained from the processing chamber to the tank;

a filter, disposed in the tank, for filtering the grinding water to be separate from processing debris, the filter having a sealed hollow portion;

a water suction pump; and a water suction passage which connects the hollow portion to the pump, and through which the grinding water filtered by the filter is sucked by suction of the pump.

10. The eyeglass lens processing apparatus according to claim 9, further comprising:

a water supply unit for supplying the grinding water stored in the tank to the processing chamber.

11. The eyeglass lens processing apparatus according to claim 10, further comprising:

a water supply passage which connects the pump to the tank, and through which the grinding water sucked by the pump is supplied to the tank.

12. A processing debris separating device for separating grinding water, used for processing an eyeglass lens and drained to a tank, from processing debris, comprising:

a filter, disposed in the tank, for filtering the grinding water to be separate from the processing debris, the filter having a sealed hollow portion;

a water suction pump; and a water suction passage which connects the hollow portion to the pump, and through which the grinding water filtered by the filter is sucked by suction of the pump.

13. A grinding water tank unit which enables reuse of grinding water that has been used for processing an eyeglass lens, comprising:

a first tank in which the grinding water is stored;

a filter for filtering the grinding water to be separate from processing debris, the filter having a chamber in which the processing debris is accumulated;

a pressurizing pump;

a water suction passage which connects the first tank to the pump, and through which the grinding water in the first tank is sucked by suction of the pump; and a first water supply passage which connects the pump to the chamber of the filter, and through which the grinding water sucked by the pump is supplied to the chamber under a predetermined water pressure.

14. The tank unit according to claim 13, wherein the filter is disposed in the first tank.

15. The tank unit according to claim 13, wherein the filter is disposed in a second tank provided outside the first tank.

16. The tank unit according to claim 15, further comprising:

a second water supply passage which connects the second tank to the first tank.

17. The tank unit according to claim 15, further comprising:

an anti-foaming device for eliminating bubbles developing in the first tank.

18. An eyeglass lens processing apparatus for processing an eyeglass lens, comprising:

a processing chamber in which a lens grinding tool is disposed;

a tank in which grinding water is stored;

a drain passage through which the grinding water is drained from the processing chamber to the tank;

a filter for filtering the grinding water to be separate from processing debris, the filter having a chamber in which the processing debris is accumulated;

a pressurizing pump;

a water suction passage which connects the tank to the pump, and through which the grinding water in the tank is sucked by suction of the pump; and a water supply passage which connects the pump to the chamber of the filter, and through which the grinding water sucked by the pump is supplied to the chamber under a predetermined water pressure.

19. The eyeglass lens processing apparatus according to claim 18, further comprising:

a water supply unit for supplying the grinding water stored in the tank, to the processing chamber.

20. A processing debris separating device for separating grinding water, used for processing an eyeglass lens and drained to a tank, from processing debris, comprising:

a filter for filtering the grinding water to be separate from the processing debris, the filter having a chamber in which the processing debris is accumulated;

a pressurizing pump;

a water suction passage which connects the tank to the pump, and through which the grinding water in the tank is sucked by suction of the pump; and a water supply passage which connects the pump to the chamber of the filter, and through which the grinding water sucked by the pump is supplied to the chamber under a predetermined water pressure.

* * * * *